United States Patent [19]

Koschek

[11] 4,151,785

[45] May 1, 1979

[54] APPARATUS FOR REMOTE POSITION INDICATION IN A HYDRAULIC POSITIONING DRIVE WITH A PHYSICALLY SEPARATED WORK CYLINDER

[75] Inventor: Gerald Koschek, Waldbronn, Fed. Rep. of Germany

[73] Assignee: Siemens Aktiengesellschaft, Munich, Fed. Rep. of Germany

[21] Appl. No.: 773,674

[22] Filed: Mar. 2, 1977

[30] Foreign Application Priority Data

Mar. 1, 1976 [DE] Fed. Rep. of Germany ..... 2608467

[51] Int. Cl.[2] ..... F15B 13/04

[52] U.S. Cl. ..... 91/32; 60/546; 91/171; 91/189 R; 91/520

[58] Field of Search ..... 91/1, 32, 171, 361, 91/363 R, 413, 414, 189; 60/546, 560, 534

[56] References Cited

U.S. PATENT DOCUMENTS

| | | | |
|---|---|---|---|
| 3,106,084 | 10/1963 | Hoffman | 91/363 R |
| 3,543,645 | 12/1970 | Baatrup | 91/413 |
| 3,648,565 | 3/1972 | Probst | 91/171 |
| 3,712,180 | 1/1973 | Pieper | 91/414 |
| 3,855,794 | 12/1974 | Meyer | 60/546 |
| 4,006,664 | 2/1977 | Brown | 60/546 |
| 4,037,519 | 7/1977 | Miller | 91/361 |

*Primary Examiner*—Martin P. Schwadron
*Assistant Examiner*—Abraham Hershkovitz
*Attorney, Agent, or Firm*—Kenyon & Kenyon, Reilly, Carr & Chapin

[57] ABSTRACT

A hydraulic positioning drive with a physically separated work cylinder which is connected via pressure oil lines, comprises a follow-up cylinder mounted at the positioning drive or in the immediate vicinity thereof, of the same type and the same volume as the work cylinder, which is hydraulically connected in series with the latter, so that its piston moves synchronously with that of the work cylinder. The piston position of the follow-up cylinder is sensed electrically and used as the positioner position. For synchronizing, both cylinders are connected in parallel from time to time and their pistons are run into the end positions.

3 Claims, 1 Drawing Figure

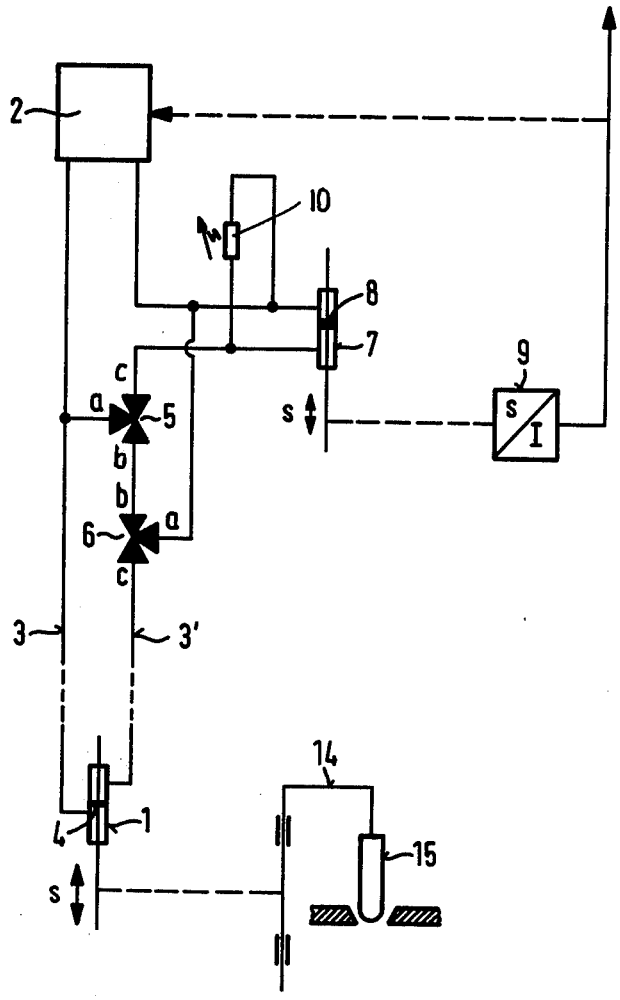
2
10
8
7
9
s
I
c
a
5
b
b
6
a
c
3
3'
14
4
1
15
s

APPARATUS FOR REMOTE POSITION INDICATION IN A HYDRAULIC POSITIONING DRIVE WITH A PHYSICALLY SEPARATED WORK CYLINDER

BACKGROUND OF THE INVENTION

This invention relates to position indicating in general and more particularly to improved apparatus for remote position indication in a hydraulic positioning drive with a physically separated work cylinder.

Hydraulic positioning drives of this type, in which the pressure supply system and the hydraulic control devices are separated from the work cylinder moving the positioner, are used where the positioner must be operated in a location exposed to vibration, dirt or temperature or in a confined space. This is the case, for instance, in an extrusion casting machine, where the plug of the pouring ladle is the positioner.

Since in customary double acting work cylinders a certain amount of leakage cannot be avoided, it is necessary to provide a remote indication of the position of the piston in the work cylinder to the positioning drive or to a control integrated into, or controlling, the latter. This remote indication can be accomplished mchanically, e.g., via Bowden cables, or electrically by means of a potentiometer tap actuated by the piston rod of the work cylinder. Both possibilities have considerable disadvantages in practice. The length of the mechanical transmission is limited and is subject to damage. With the electrical position indication, contact problems in the potentiometers must be expected over a period of time; if the positioning cylinder is in an exposed location, a potentiometer cannot always be mounted mechanically in an operationally safe manner.

Thus, there is a need to provide a better arrangement to obtain a remote position for a hydraulic positioning drive with a physically separated work cylinder which is operable even under difficult conditions and does not have the above mentioned shortcomings.

SUMMARY OF THE INVENTION

The present invention fills this need by disposing, at the positioning drive, a follow-up cylinder, the type and volume of which are the same as those of the physically separated work cylinder and the piston position of which can be electrically sensed as a feedback signal, and by providing switching means for selectably connecting the work cylinder and the follow-up cylinder in series or in parallel.

For normal positioning operation, the work cylinder and the follow-up cylinder are hydraulically connected in series, so that their pistons move synchronously. The feedback signal sensed at the follow-up cylinder corresponds to the position of the piston in the work cylinder. In order to equalize the position differences which are possible with time due to different leakage rates in the two cylinders, the two pistons are driven to their end positions at certain time intervals, by connecting the work cylinder and the follow-up cylinder in parallel, and are thereby synchronized again.

To take care of the case wherein, if the pistons of the follow up cylinder and the work cylinder run asynchronously, the piston of the follow up cylinder arrives at its end position before the work piston has reached its end position, in accordance with a further feature of the present invention, a bypass valve is shunted across the connections of the follow up cylinder. The release pressure of the bypass valve is smaller than the operating pressure of the hydraulic loop and is preferably about 10% of the operating pressure.

BRIEF DESCRIPTION OF THE DRAWING

The single FIGURE illustrates schematically a hydraulic positioning drive for the plug regulating the uniform flow into the chilling mold of an extrusion casting machine.

DETAILED DESCRIPTION OF THE INVENTION

The work cylinder 1 of a hydraulic positioning drive 2, which positions the plug 15 of a pouring ladle of an extrusion casting machine via the linkage 14, is separated from the other parts of the positioning drive 2 because of the difficult environmental conditions prevailing. These other parts include the pressure supply and the hydraulic control equipment. The cylinder 1 is connected to the other parts of the positioning drive 2 via the pressure oil lines 3 and 3'. At the positioning drive 2 or in its vicinity, a follow-up cylinder 7 is arranged, the type and volume of which are equal to those of the work cylinder 1. The distance s' travelled by the piston 8 of the follow-up cylinder 7, which is proportional to the positioning travel s, is converted by means of an electrical distance converter 9 into a proportional electric current and fed to the feedback circuit of the positioning drive 2 or to the regulator controlling it. In addition, the output current can be recorded and gives information as to the current state of the plug (burn-off, deposits).

For control operation, three-way valves 5 and 6 which are arranged in tandem in the pressure oil line 3', are connected so that conduction is always in the direction b-c and, thus, the work cylinder 1 and the follow-up cylinder 7 are connected in series with the positioning drive 2.

Thus, the piston 8 of the follow-up cylinder 7 moves synchronously with the piston 4 of the work cylinder 1, so that the remote position indicating signal can be taken from the travel of piston 8 as described above.

Since the two pistons 4 and 8 can drift apart due to the different leakage rate in their piston seals, the work cylinder 1 and the follow-up cylinder 7 are connected in parallel at predetermined times by means of the three-way valves 5 and 6. To accomplish this the switching position of valves 5 and 6 is set to a-c for long enough that both pistons 4 and 8 to move to an end position. The pistons 4 and 8 are thus synchronized again.

In order to prevent blocking of the piston 4 in the work cylinder 1 if, when running asynchronously, the piston 8 of the follow up cylinder 7 has reached an end position, for instance, because of lack of synchronization prior to the pouring operation, a bypass valve 10 is shunted across the connections of the follow up cylinder 7. The release pressure of the bypass valve 10 is lower than the operating pressure of the hydraulic loop and is preferably about 10% of the operating pressure. This insures that the piston 4 of the work cylinder 1 can also properly run into an end position, which automatically brings about synchronization.

The nature of the positioning drive 2 is not important to the present invention. All that is important to know is that the positioning drive is a device which normally acts to position the piston 4 in cylinder 1. Normally, prior art arrangements would have the two lines out of the positioning drive 2 coupled directly to the cylinder 1. Feedback of the mechanical position of the piston would then be provided to the positioning drive 2 to provide closed loop control. This is simply a hydraulic servo loop. The problem with such prior art arrangements as stated above is that in some cases it is not easy to get the position feedback because of difficult conditions in the area of the work cylinder. The solution to this problem is the inclusion of the follow up cylinder 7.

During normal operation, again as explained above, the two cylinders are connected in series. What this means is that if it is desired to drive the piston 4 downward, for example, fluid will be supplied over the right-hand line coming out of the positioning drive 2. This fluid will act to push the piston 8 downward causing fluid from below the piston to flow through the valves 5 and 6 to the upper end of the cylinder 1, above the piston 4 pushing it downward. Since the two pistons and cylinders are identical, they will track each other and thus, the mechanical position of the piston 8 can be used in the converter 9 to provide a follow-up signal back to the positioning drive 2. It is possible under some circumstances that, due to leakage or other causes, this tracking will not be maintained. Thus, it is possible to connect the two pistons in parallel by means of the valves 5 and 6, and to drive them to one end or the other. When both are in the same end position they are then resynchronized. With respect to parallel operation it can be seen that when the valve 6 is in the a-c position, the top of the cylinder 1 and the top of the cylinder 7 will be connected in parallel. With the valve 3 also in the a-c position, the bottom of the cylinder 7 will be in parallel with the bottom of the cylinder 1.

With respect to the overflow or bypass valve across cylinder 7, this is for the safe synchronous operation of the pistons 4 and 8. Should it occur that, during the time intervals between the periodic parallel connection of the cylinders for synchronization, the piston 8 in cylinder 7 reaches its end position before the piston 4 in work cylinder 1 does, the overflow valve 10 will open until piston 4 has also reached a corresponding final position. In serial operation of the cylinders, essentially the same pressure prevails at both sides of the piston 8; the differential pressure acting on the overflow valve is practically zero. If, for example, piston 8 reaches its lower final position, the pressure at the upper part of cylinder 7 increases. Pressure builds up at the bypass valve 10, which opens it even with a small volume.

With respect to the distance converter 9, its output can be supplied to an indicating or registering device and it may operate as the feedback signal, over the dotted line to the positioning drive 2. Once again, it is believed that such closed loop control of hydraulic devices is well known in the art and a discussion of the manner in which the position signal is fed back to the positioning drive which provide a hydraulic output until a null is reached, should not be necessary in the present specification.

The apparatus of the present invention for remote position indication described above can be used without any problem as a retrofit set for standard and already installed hydraulic positioning drives.

What is claimed is:

1. In a hydraulic system which includes a hydraulic positioning drive having first and second hydraulic lines which alternately provide a pressure output and return line for forward and reverse positioning and work a cylinder containing a piston and having first and second connections for connecting to said hydraulic lines for driving said piston in opposite directions, the drive being located remotely from the work cylinder, apparatus for sensing the position of the work cylinder, disposed at a location in the vicinity of the drive, in order to provide a feedback signal for controlling the drive comprising:

(a) a follow up cylinder, located in the vicinity of the positioning drive, of the same type and of the same volume as the work cylinder and similarly containing a piston and first and second connections for hydraulic lines, the first hydraulic line from said positioning drive coupled to the first connection of said follow up cylinder;

(b) a first three-way valve having its first inlet coupled to the second connection of said follow up cylinder;

(c) a second three-way valve having its second inlet coupled to the second connection of said first valve and its first inlet coupled to the first connection of said work cylinder, the second hydraulic line from said drive being coupled to the second connection of said work cylinder;

(d) a connection between the first hydraulic line of said positioning drive and the third inlet of said second valve; and (e) a connection between the second hydraulic line of said positioning drive and the third inlet of said first valve, whereby by setting said first and second valves so that their first and second inlets are in communication, said work cylinder and follow up cylinder will be placed in series and by placing said valves so that their first and third inlets are in communication, said work cylinder and follow up cylinder will be connected in parallel.

2. Apparatus according to claim 1 and further including a bypass valve disposed across the two sides of said follow-up cylinder, the release pressure of which is lower than the operating pressure of the hydraulic system.

3. Apparatus according to claim 2 wherein the release pressure of said bypass valve is about 10% of the operating pressure.

* * * * *